United States Patent [19]

DiGirolomo et al.

[11] 3,941,308

[45] Mar. 2, 1976

[54] CONTINUOUS MAILER ENVELOPE ASSEMBLY WITH INSERTS AND METHOD

[75] Inventors: John S. DiGirolomo, West Carrollton; Marino Giuffre, Dayton; Hugh B. Skees, Dayton; F. Leo Vath, Brookville, all of Ohio

[73] Assignee: The Standard Register Company, Dayton, Ohio

[22] Filed: Oct. 31, 1974

[21] Appl. No.: 519,575

[52] U.S. Cl. ..... 229/69; 53/31; 93/63 M; 282/11.5 A

[51] Int. Cl.[2] ..... B65D 27/10

[58] Field of Search..... 229/69; 282/11.5 R, 11.5 A, 282/25; 93/63 M; 53/31

[56] References Cited

UNITED STATES PATENTS

| | | | |
|---|---|---|---|
| 3,104,799 | 9/1963 | Steidinger | 229/69 |
| 3,339,827 | 9/1967 | Steidinger | 229/69 |
| 3,437,259 | 4/1969 | Steidinger | 282/11.5 A |
| 3,554,438 | 1/1971 | Van Malderghem | 229/69 |
| 3,830,141 | 8/1974 | Steidinger | 53/31 |

*Primary Examiner*—William Price
*Assistant Examiner*—Stephen P. Garbe
*Attorney, Agent, or Firm*—Jacox & Meckstroth

[57] ABSTRACT

Business forms structure which comprises continuous envelopes with insert material. The envelopes are produced in a series and separated by score lines or the like. Within each envelope is at least one element of insert material. Image transfer material is included in the business forms structure so image transfer can occur from the exterior surface of the envelope to the insert material within the envelope. Each element of insert material is attached to an element of insert material in the adjoining envelopes and is retained in a desired position within its respective envelope until the envelope is separated from the series thereof. Thus, printing, typing, and the like can be performed upon the exterior surface of the envelope and, while the insert material is retained in proper location within the envelope, at least a portion of the printed or typed information is applied to the insert material in the desired location thereupon, prior to separation of the envelope from the series thereof.

34 Claims, 10 Drawing Figures

FIG-4
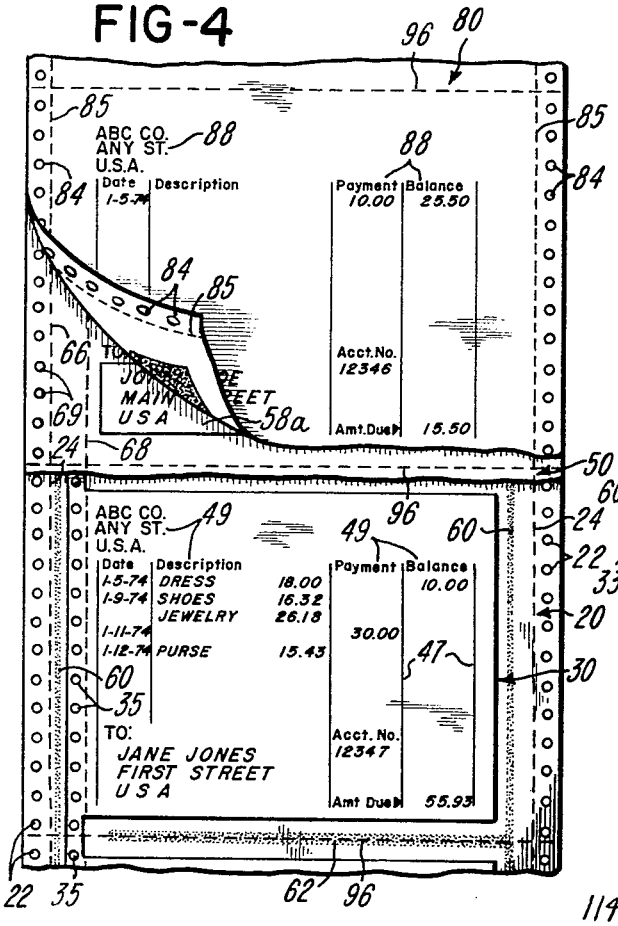
FIG-5
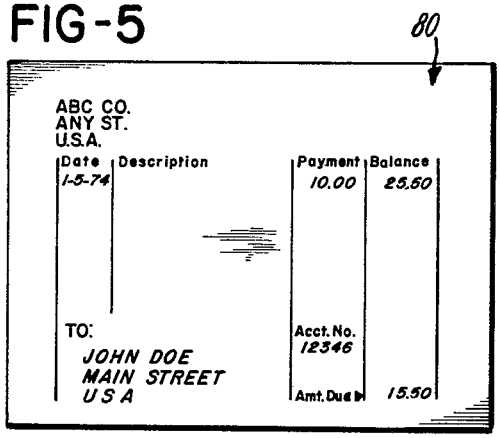
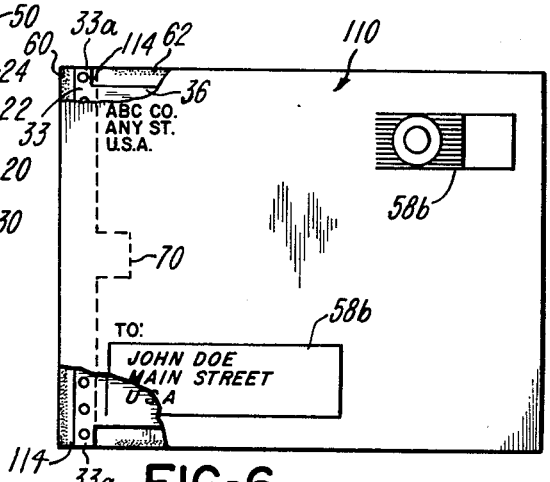
FIG-6
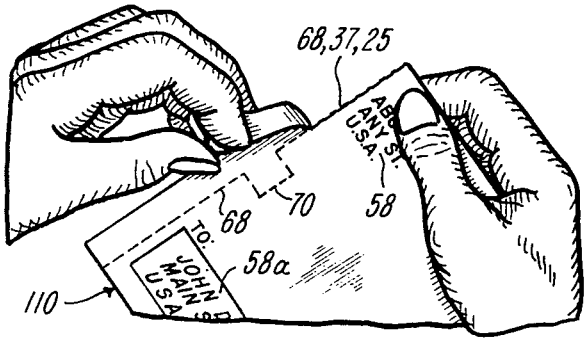
FIG-7
FIG-8
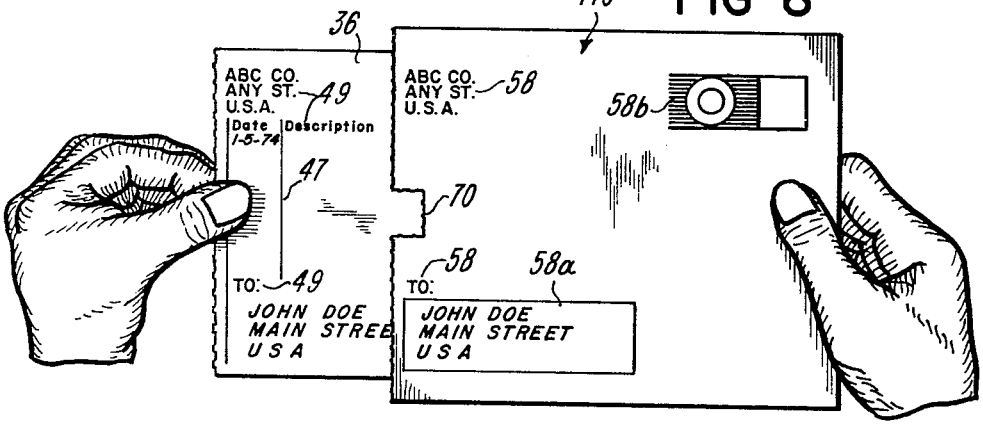

FIG-9
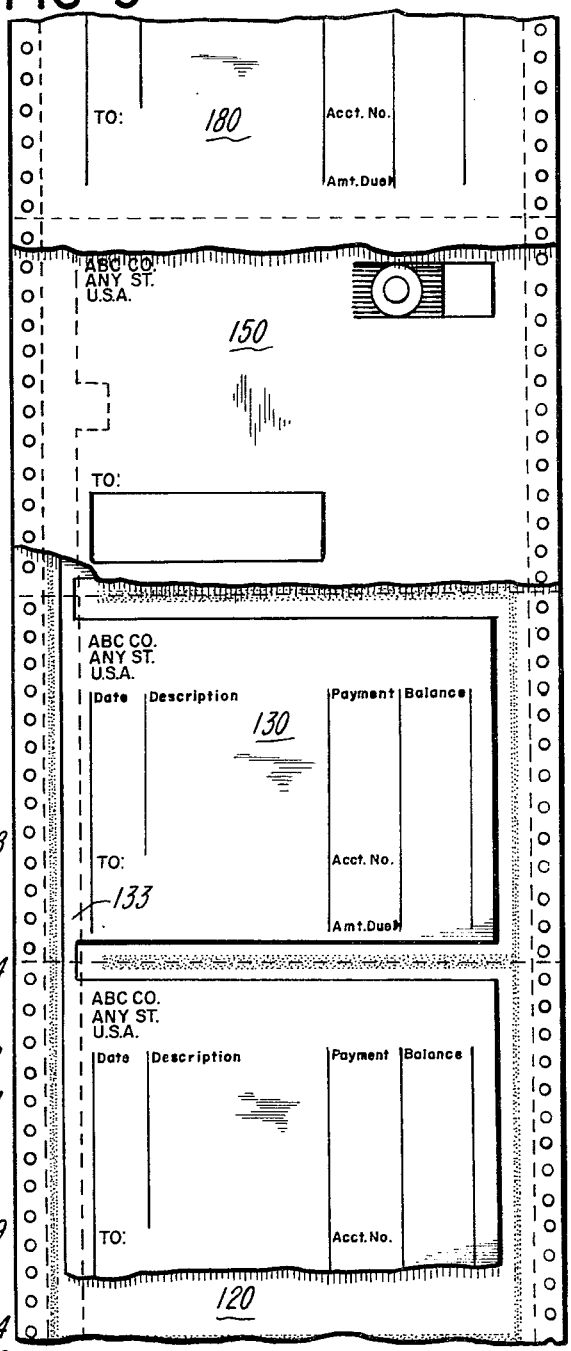
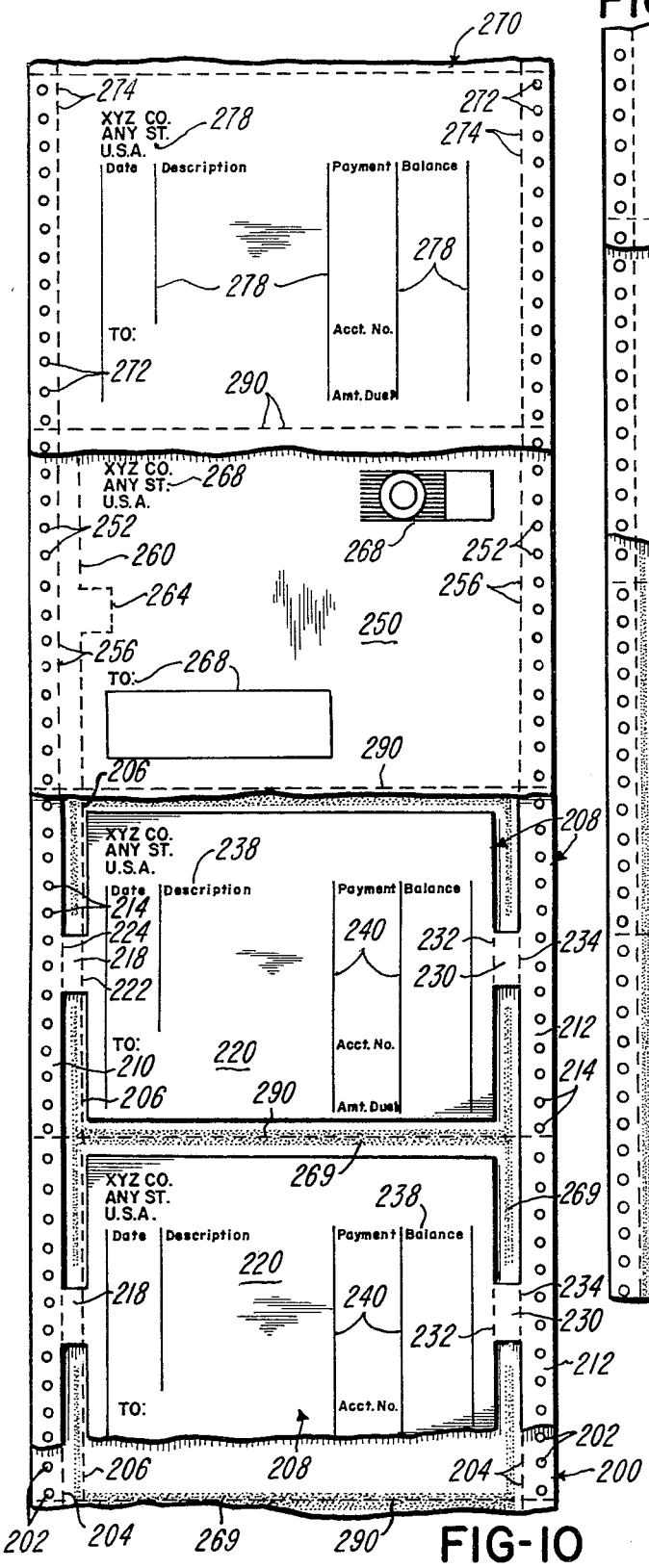
FIG-10

CONTINUOUS MAILER ENVELOPE ASSEMBLY WITH INSERTS AND METHOD

BACKGROUND OF THE INVENTION

Numerous business forms structures have been created which comprise a series of envelopes and insert material within the envelopes. Each of these business forms structures has been produced in a continuous operation. The major problem involved in production of such continuous envelopes with inserts in a continuous production operation is that of retaining the insert material in desired position within the envelopes during formation of the envelopes and insert material, and during the process of typing or printing thereon, while also permitting the insert material to be easily and readily removed from the envelopes by the recipients thereof. Various types of means have been provided for solving this problem. Some of the known envelope structures are disclosed in U.S. Pat. No. 2,149,886, 2,257,766, 3,104,799, 3,339,827, 3,777,971, 3,790,470, and 3,830,141.

Several of the known continuous envelope structures with inserts are rather expensive to produce; other such known structures have an undesirable appearance; other such known structures are such that the insert material is difficult to remove from the envelopes; other such known structures do not fold smoothly into a pack; and other such known structures are not acceptable for use with high speed printer machines.

An object of this invention is to provide business forms structure which comprises continuous envelopes with inserts therewithin which includes means for retaining the insert material in desired position within the envelopes until each envelope is separated from the series thereof for mailing of the envelope.

Another object of this invention is to provide such business forms structure which can be produced at relatively low costs, which has a good appearance, and in which the insert material is easily removable from each envelope.

It is another object of this invention to provide such business forms structure which folds neatly and smoothly into a pack for shipment thereof and/or for subsequent use thereof and which moves smoothly through high speed printer machines.

Other objects and advantages of this invention reside in the construction of parts, the combination thereof, the method of manufacture, and the method of use, as will become more apparent from the following description.

SUMMARY OF THE INVENTION

This invention comprises a plurality of continuous superposed sheets of paper-like material, at least two of the continuous sheets forming a series of envelopes, at least one of the continous sheets being an insert sheet which extends through the series of envelopes. In the continuous structure, the insert material is maintained in desired position within the envelopes during construction of the assembly, during travel thereof, and during printing or typing operation thereupon. A continuous strip, as a portion of the insert material, extends through the entire series of envelopes. The continuous structure moves smoothly through high speed printing machines and the like. After each envelope is severed from the series thereof, the insert material therewithin is freely movable within the envelope and is easily and readily removable from the envelope.

BRIEF DESCRIPTION OF THE VIEWS OF THE DRAWINGS

FIG. 4 is a top plan view, with portions of the assembly broken away and illustrating the manner in which information is applied to the continuous sheets of the assembly.

FIG. 5 is a top plan view showing a portion of the upper sheet of the assembly with information applied thereto.

FIG. 6 is a top plan view, with portions broken away, illustrating a mailer envelope unit of the assembly of this invention within which insert material is positioned and upon which some of the information carried by the upper sheet appears.

FIG. 7 is a fragmentary perspective view illustrating the method of gaining access to the insert material which is within the envelope unit of FIG. 6.

FIG. 8 is a plan view, illustrating a step in removal of the insert material from the envelope unit.

FIG. 9 is a top plan view, with parts broken away, showing a modification in the mailer envelope assembly of this invention.

FIG. 10 is a top plan view with parts broken away, of another modification in the mailer envelope assembly of this invention.

DESCRIPTION OF THE PREFERRED EMBODIMENTS

Figure 1:
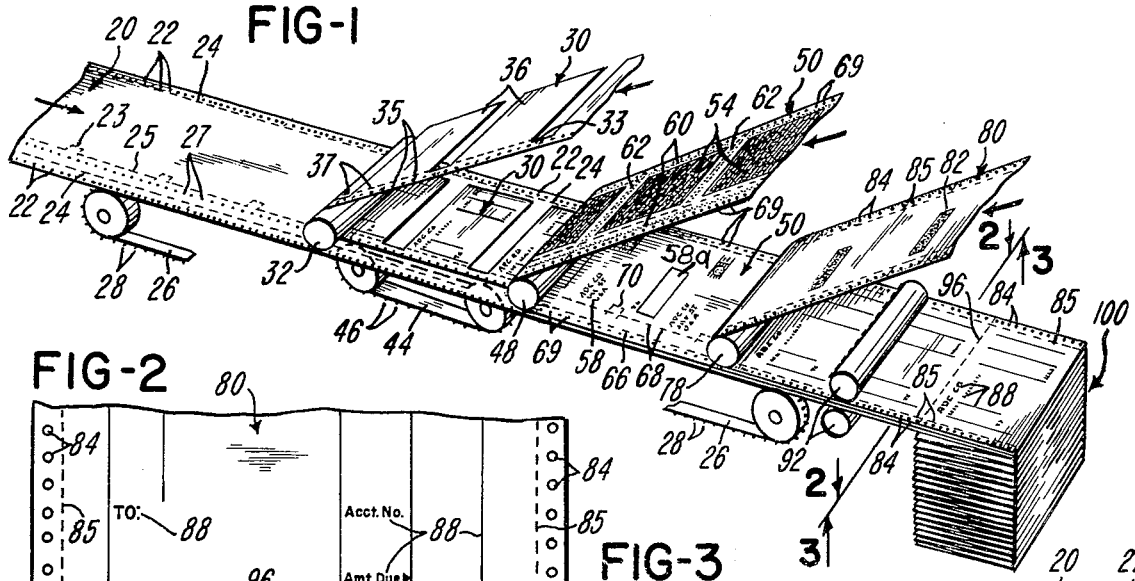
FIG. 1 is a perspective view illustrating production of a continuous mailer envelope assembly with inserts in accordance with this invention.
Figure 3:
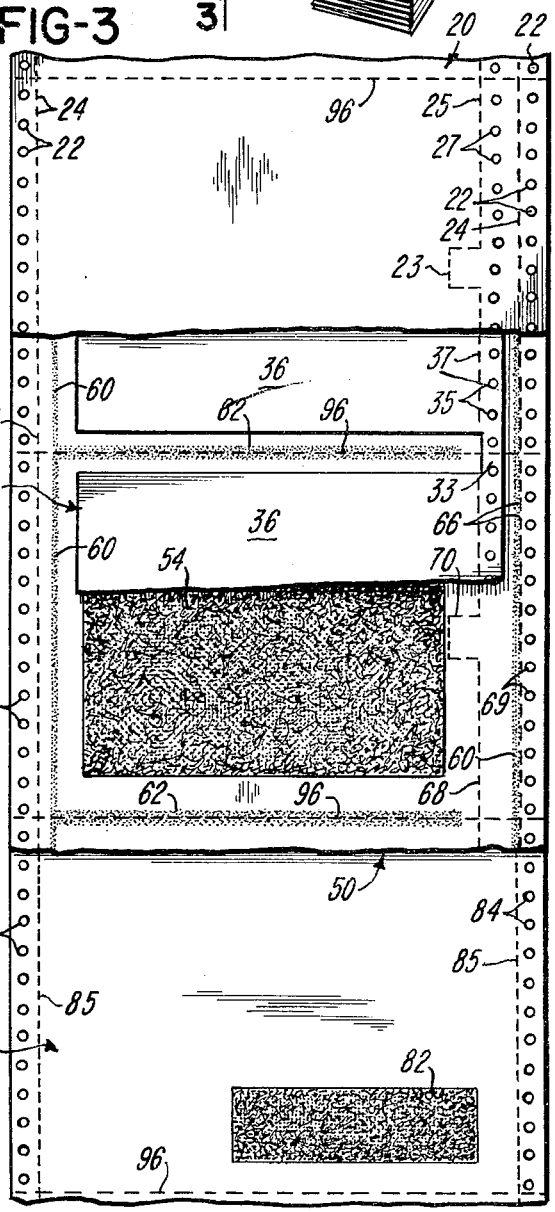
FIG. 3 is an enlarged bottom plan view taken substantially on line 3—3 of FIG. 1.

FIG. 1 illustrates a method of production of a continuous mailer envelope assembly with inserts according to this invention. A continuous sheet 20, as illustrated in FIG. 1, moves from left to right. The continuous sheet 20 is provided with a longitudinal row of closely spaced feed holes 22 along each margin thereof. Adjacent each row of feed holes 22 and substantially parallel thereto is a longitudinal perforation line 24. Spaced slightly inwardly from one of the perforation lines 24 and parallel thereto is a longitudinal perforation line 25. The perforation line 25 is interrupted by notch perforation lines 23 which extend inwardly therefrom, as shown in FIG. 3. Between the perforation lines 24 and 25 is a longitudinal row of feed holes 27.

As illustrated in FIG. 1, a continuous rotating belt 26, at each marginal portion of the sheet 20, has feed pins 28 which move into the holes 22 at the respective margin of the sheet 20 for movement thereof.

Also, as illustrated in FIG. 1, a continuous sheet 30 is laid down upon the first continuous sheet 20, as the second continuous sheet moves around a roller 32 above the first continuous sheet 20. The second continuous sheet 30 has a lesser width than the width of the continuous sheet 20. The continuous sheet 30 has a continuous strip portion 33 at one marginal edge thereof. The continuous strip portion 33 of the continuous sheet 30 is provided with a longitudinal row of feed holes 35. Adjacent the feed holes 35 is a longitudinal perforation line 37. By a die cut operation or the like, the continuous sheet 30 has form sections or insert sections 36 which extend laterally from the continuous strip portion 33. As the continuous sheet 20 is moved by the belt 26 and the feed pins 28 thereof, the continuous sheet 30 moves around the rotating roller 32 and into engagement with the first continuous sheet 20.

As the continuous sheet 30 moves into engagement with the continuous sheet 20, each of the feed holes 35 becomes vertically aligned with one of the feed holes 27 of the continuous sheet 20, and the longitudinal perforation line 37 becomes positioned directly above the longitudinal perforation line 25 of the sheet 20.

A continuous annular belt 44 is positioned below the rows of feed holes 27 and 35, and pins 46 of the belt 44 extend through aligned holes 27 and 35 in the continuous sheets 20 and 30, respectively, for aligned movement of the continuous sheets 20 and 30.

Figure 2:
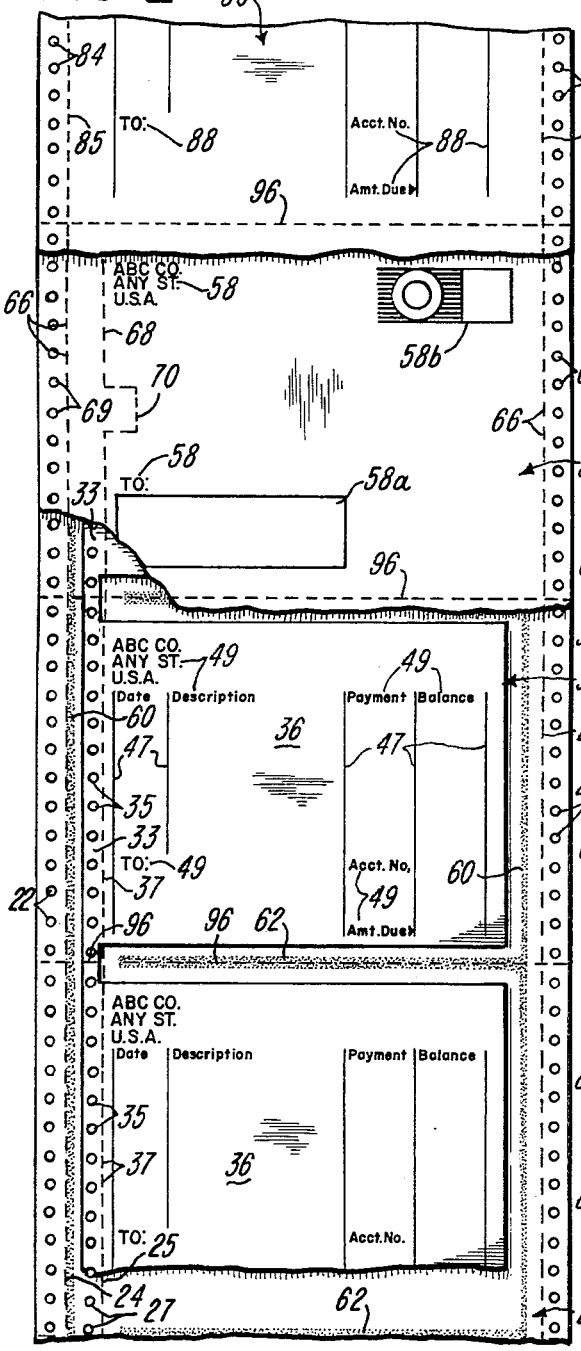
FIG. 2 is an enlarged top plan view taken substantially on line 2—2 of FIG. 1.

Spaced from the roller 32 is a roller 48 under which the continuous sheets 20 and 30 travel. The belt 44 is positioned below the portions of the continuous sheets 20 and 30 which are between the rollers 32 and 48. The continuous sheet 30 may have printed indicia 49 and column lines 47 thereupon, as shown in FIG. 2.

A continuous sheet 50 also travels under the roller 48, as illustrated in FIG. 1, and has a lower surface which moves into engagement with the upper surface of the continuous sheet 30 and a portion of the upper surface of the continuous sheet 20. The lower surface of the sheet 50 is provided with areas or regions 54 having image transfer material thereupon, such as carbon material, or any other suitable image transfer composition, as shown in FIGS. 1 and 3. The upper surface of the continuous sheet 50 is shown as having printed material 58 thereupon, including an address rectangle 58*a*. The lower surface of the sheet 50 has longitudinal lines 60 of adhesive material and transverse lines 62 of adhesive material. As the sheet 50 moves into engagement with the upper surfaces of the sheets 20 and 30, the transverse lines 62 of adhesive are spaced between adjacent insert sections 36 of the continuous sheet 30 but are spaced significantly therefrom. The lines 60 and 62 are also spaced significantly from the continuous strip portion 33 of the continuous sheet 30.

The continuous sheet 50 has longitudinal perforation lines 66 which are positioned directly above the longitudinal perforation lines 24 of the continuous sheet 20. The sheet 50 has a longitudinal perforation line 68 which is positioned directly above the longitudinal perforation line 37 of the sheet 30 and the longitudinal perforation line 25 of the sheet 20. The longitudinal perforation line 68 is interrupted at regularly spaced positions and has thumb notch perforation lines 70 joined thereto, as shown in FIGS. 1, 2, and 3. The sheet 50 has rows of marginal feed holes 69 which are aligned with the marginal feed holes 22 of the sheet 20.

The lines of adhesive material 60 and 62, in a generally rectangular formation, thus attach the sheet 50 to the sheet 20 along the length thereof to form a series of envelope pockets. Within each envelope pocket is one of the insert sections 36 of the continuous sheet 30. The continuous strip 33, which is integral with the insert sections 36, extends from each envelope pocket to the adjacent envelope pockets, while the continuous sheet 30 remains detached from the sheets 20 and 50 and spaced from the lines of adhesive material 60 and 62. Thus, registration of the insert sections 36 with the sheets 20 and 50 is assured by the continuous integral strip 33.

The sheets 20, 30, and 50 then continue to move under the influence of the rotating belt 26 and the feed pins 28 thereof to a rotating roller 78, which directs a continuous sheet 80 upon the upper surface of the sheet 50, as illustrated in FIG. 1. The lower surface of the sheet 80 is provided with areas 82 of image transfer material of any suitable type. The sheet 80 has longitudinally extending rows of marginal feed holes 84, adjacent longitudinal perforation lines 85. The perforation lines 85 of the sheet 80 are positioned directly above the perforation lines 66 of the sheet 50 and the perforation lines 24 of the sheet 20. The feed holes 84 are aligned with the feed holes 69 of the sheet 50 and the feed holes 22 of the sheet 20. The sheet 80 is releasably attached to the upper surface of the sheet 50 by any suitable means such as by crimps or by releasable glue or the like. The sheet 80 is shown as having printed material 88 applied thereto on the upper surface thereof, as shown in FIG. 2.

The sheets 20, 30, 50, and 80 then move forwardly to perforating rollers 92 and travel therebetween. The perforating rollers 92 form spaced-apart transverse perforation lines or lines of weakening 96 through all the sheets 20, 30, 50, and 80. The perforation lines 96 extend through the transverse lines of adhesive material 62 which attach together transverse portions of the sheets 20 and 50, as each insert section 36 is positioned between a pair of adjacent transverse perforation lines 96. Each transverse perforating operation performed by the rollers 92 also perforates the continuous strip portion 33 which joins one insert section 36 to an adjacent insert section 36.

Thus, between each adjacent pair of perforation lines 96 is an envelope formed by the sheets 20 and 50, and within each envelope is an insert section 36 within a pocket formed within each envelope. Each insert section 36 is joined to the insert sections 36 in the adjacent envelopes by the continuous strip portion 33 which extends through the series of envelopes. The continuous strip portion 33 freely extends through an opening at the top and bottom of each envelope, the opening being formed between spaced-apart portions of the lines of adhesive material 60 and 62.

From the perforating rollers 92 the continuous sheets 20, 30, 50, and 80, as a continuous web, move forwardly and are shown traveling to a stack 100, as the sheets 20, 30, 50, and 80 are folded at the transverse perforation lines 96. Due to the fact that the series of insert sections 36 are joined by the continuous strip portion 33 which is free and unattached to the envelopes, the continuous web folds smoothly without wrinkling or tenting.

In such a stack 100, the continuous web comprising the sheets 20, 30, 50, and 80 can be shipped or moved to a location for further use. The continuous web formed by the sheets 20, 30, 50, and 80 is adapted to travel from the stack 100 thereof through a printer machine, typewriter, or the like. Information is applied to the sheet 80 at desired locations thereupon, and at least some of the information is applied by the image transfer material in the areas 82 on the lower surfaces of the sheet 80 to the sheet 50, and at least a portion of the information which is applied to the sheet 80 is also applied to the insert sections 36 of the sheet 30 by image transfer material in the areas 54 on the lower surface of the sheet 50. The sheet 80 thus becomes a record sheet of all information applied.

The sheet 80 is then removed from the sheet 50 and may be maintained as a continuous sheet or may be separated into smaller sheets by severance at the perforation lines 96.

The marginal portions of the sheets 80, 50, and 20 having the feed holes therein are separated from these sheets by separation of the marginal portions along the perforation lines 85, 66, and 24, respectively.

FIG. 5 shows a portion of a record sheet 80 after the marginal portions are removed therefrom and after severance along the perforation lines 96.

FIG. 6 shows an envelope unit 110 with an insert section 36 therein, formed by the sheets 20, 30, and 50. FIG. 6 shows a tab part 33a of the continuous strip portion 33 which extends from the insert section 36 through openings 114 in the upper and lower edges of the envelope unit, between spaced-apart portions of the lines of adhesive material 60 and 62. The insert section 36, now severed from the continuous strip portion 33, is free to shift within the envelope unit 110. A portion of the printed information 58 on the surface of the envelope unit 110 comprises postage **58*b* and a name and an address within the address rectangle 58*a*. In this condition the envelope unit 110** is ready to be mailed.

FIG. 7 illustrates the manner in which the envelope unit 110 is opened by the recipient thereof. The sheets 50, 30, and 20 are torn at the perforation lines 68, 37, and 25, respectively. The portion of these sheets thus removed includes the notch portion defined by the notch perforation lines 70 of the sheet 50 and by the notch perforation lines 23 of the sheet 20. Thus, the part of the continuous strip portion 33 of the sheet 30 is removed with a part of the sheets 20 and 50, and a part of the insert section 36 is visible and accessible through the thumb notch formed by tearing at the notch perforation lines 23 and 70 of the sheets 20 and 50, respectively. Thus, the insert section 36 is readily removed from the envelope unit 110.

It is to be understood that insert material of an assembly of this invention may consist of a single sheet, as herein illustrated. The insert material may include a return envelope or the like and a plurality of sheets or sections of sheets.

FIG. 9

FIG. 9 shows a modification in the assembly of this invention. In the assembly of FIG. 9 there is a continuous sheet 120, a continuous sheet 130, a continuous sheet 150, and a continuous sheet 180. Each of these sheets is similar to the sheets 20, 30, 50, and 80, respectively, shown in the drawings and discussed above. The sheet 130 has a continuous strip portion 133 extending the length thereof. However, the sheet 130 is laid upon the sheet 120 without the use of feed holes in the continuous strip portion 133. Thus, the continuous strip portion 133 does not have feed holes therein, and the sheet 120 does not have feed holes below the continuous strip portion 133 of the sheet 130, and the continuous sheet 150 does not have feed holes above the continuous strip 133.

FIG. 10

FIG. 10 shows another modification in the assembly of this invention. A continuous sheet 200 is provided with longitudinally extending rows of feed holes 202. A longitudinal perforation line 204 is adjacent each row of feed holes 202. The continuous sheet 200 also has a longitudinal perforation line 206 at the left hand portion thereof.

A continuous sheet 208 rests upon the continuous sheet 200. By means of a die cutter or by other suitable means, the continuous sheet 208 has a continuous marginal strip 210 at one side portion thereof and a continuous marginal strip 212 at the other side portion thereof. Extending laterally inwardly from the continuous marginal strip 210 are a series of spaced-apart tabs 218 which are joined to spaced-apart insert sections 220, herein shown as being rectangular in shape and spaced from the marginal strips 210 and 212. Within each of the continuous marginal strips 210 and 212 is a row of feed holes 214, each of which is aligned with the feed holes 202 in the continuous sheet 200. a perforation line 222 in the tab 218 is positioned directly above the perforation line 206 in the continuous sheet 200. A perforation line 224 in the continuous sheet 208 separates the continuous strip 210 from each tab 218 and is positioned directly above the perforation line 204 at the left hand portion of the continuous sheet 200.

A tab 230 extends laterally inwardly from the continuous strip 212 to each insert section 220. A perforation line 232 separates each insert section 220 from its respective tab 230. A perforation line 234 in the continuous sheet 208 separates the continuous strip 212 from the tab 230.

As shown, the insert sections 220 have printed indicia 238 and lines 240 thereupon.

Positioned upon the continuous sheet 208 is a continuous sheet 250, which is provided with marginal rows of feed holes 252, which are aligned with the rows of feed holes 214 in the continuous sheet 208. The continuous sheet 250 also has a perforation line 256 which is adjacent each of the rows of feed holes 252. Adjacent the left hand portion of the continuous sheet 250 is a perforation line 260 which is directly above the perforation line 222 in the continuous sheet 208 and above the perforation line 206 in the continuous sheet 200. The perforation line 260 in the continuous sheet 250 is interrupted at spaced-apart positions by thumb notch perforation lines 264. The continuous sheet 250 is shown as having printed indicia 268 thereupon.

The continuous sheet 250 is attached to the continuous sheet 200 by glue lines 269 which partially encompass each insert section 220. The glue lines 269 are spaced from the insert sections 220 and from the marginal strips 210 and 212 and spaced from the tabs 218 and 230.

Positioned upon the continuous sheet 250 is a continuous sheet 270 which has rows of marginal feed holes 272. Adjacent each row of marginal feed holes 272 is a longitudinal perforation line 274. The perforation lines 274 are in vertical alignment with the perforation lines 256 of the continuous sheet 250. The continuous sheet 270 is shown as having printed indicia and lines 278 thereupon.

The continuous sheet 270 is releasably attached to the continuous sheet 250 by any suitable means, such as by releasable adhesive or by crimping, or the like.

Spaced-apart transverse perforation lines 290 are applied to all of the sheets 200, 208, 250, and 270 after collating thereof and after attachment thereof as described above, and in a manner such as described with respect to the rollers 92 shown in FIG. 1.

The assembly shown in FIG. 10 thus comprises a continuous series of envelopes, each of which has an insert section 220 therewithin. The insert section 220 is not attached to the envelope within which it is disposed. During construction and movement of the continuous assembly, the insert sections 220 are maintained in desired position with respect to the envelopes by means of the continuous marginal strips 210 and 212 within which feed pins extend to maintain alignment between all of the continuous sheets of the assembly. After separation of the marginal strips and after separation of an envelope unit from the series thereof, an individual envelope unit may be opened generally in the manner illustrated in FIG. 7.

It is to be understood that an assembly similar to that shown in FIG. 10 may be constructed in which all of the tabs 230 or all of the tabs 218 are omitted, and any one tab joins each insert section to a marginal strip.

SUMMARY

Thus, it is understood that a continuous mailer envelope assembly with inserts of this invention constitutes an assembly which can be produced at relatively low costs, in which the insert material is free within the envelopes but retained in desired position within each envelope until all information is applied thereto and until the individual envelopes are separated from the series thereof. The continuous envelope assembly of this invention folds smoothly without tenting or wrinkling, can be easily opened, and the insert material is freely removable therefrom.

Although the preferred embodiment of the device has been described, it will be understood that within the purview of this invention various changes may be made in the form, details, proportion and arrangement of parts, the combination thereof, and mode of operation, which generally stated consist in a device capable of carrying out the objects set forth, as disclosed and defined in the appended claims.

The invention having thus been described, the following is claimed:

1. A busines form assembly comprising:

a first continuous sheet of paper material, the first continuous sheet having a given width dimension, the first continuous being divided into a series of sections extending along the length thereof, each section having the given width dimension which is equal to the width dimension of the sheet, each section having a given longitudinal dimension, a second continuous sheet of paper material, the second continuous sheet being positioned upon the first continuous sheet, the second continuous sheet having a series of insert portions, there being an insert portion positioned upon each section, each insert portion having an area less than the area of the section upon which the insert portion is disposed, each insert portion having a width dimension less than said given width dimension and a longitudinal dimension less than said given longitudinal dimension of the section upon which said portion is positioned, the second continuous sheet having a plurality of connecting parts, there being a connecting part joining each insert portion to the insert portion which is positioned upon the section wich is adjacent thereto, a third continuous sheet of paper material, the third continuous sheet of paper material being positioned upon the second continuous sheet, the third continuous sheet being of said given width and having sections equal in dimension to said sections of the first continuous sheet, each section of the third continuous sheet being positioned above a section of the first continuous sheet, with one of said insert portions therebetween, and means attaching the first continuous sheet to the third continuous sheet along the marginal parts of each section to form a series of envelopes, each of which has therewithin one of said insert portions of the second continuous sheet, the second continuous sheet being free from attachment to either of the other sheets.

2. A business form assembly comprising:

a first continuous sheet, the first continuous sheet having a given width dimension, the first continuous sheet being divided into a series of longitudinally extending sections, each section having the given width dimension, each section having a given longitudinal dimension, a second continuous sheet, the second continuous sheet being positioned upon the first continuous sheet, the second continuous sheet having a series of spaced-apart insert portions, there being an insert portion positioned upon each section of the first continuous sheet, each insert portion having an area less than the area of the section upon which the insert portion is disposed, the second continuous sheet including connecting means joining together the series of insert portions, a third continuous sheet, the third continuous sheet being positioned upon the second continuous sheet, the third continuous sheet being of said given width and having sections equal in dimension to said sections of the first continuous sheet, and attachment means attaching the first continuous sheet to the third continuous sheet adjacent the periphery of each section to form a series of envelopes, each of which has therewithin one of said insert portions of the second continuous sheet, the attachment means providing an opening through which the connecting means of the second continuous sheet freely extend, the second continuous sheet being free from attachment to either of the other sheets.

3. The business form assembly of claim 2 in which the connecting means comprises a relatively narrow tab which extends from each insert portion in the direction of the length of the sheet to the adjacent insert portion.

4. The business form assembly of claim 2 in which the connecting means comprises a continuous strip which is laterally positioned with respect to the insert portions and in which there is a part which extends laterally from each insert portion and joins the insert portion to the continuous strip.

5. The business form assembly of claim 2 in which the second continuous sheet has a continuous marginal portion, a portion of the second continuous sheet attaching each insert portion to the continuous marginal portion.

6. The business form assembly of claim 2 in which the first sheet and the third sheet have marginal side portions which are attached together along the length thereof and in which the first sheet and the third sheet are also attached together along the length thereof at portions spaced inwardly from the marginal side portions, the marginal side portions being provided with feed holes and being severable from the first and third sheets.

7. The business form assembly of claim 2 in which the first sheet, the second sheet, and the third sheet have marginal feed hole strips along the length thereof, and in which the second sheet has a plurality of connection parts, there being a connection part which joins the feed hole strip to each insert portion.

8. The business form assembly of claim 2 in which each of the continuous sheets has a continuous marginal portion, portions of the second continuous sheet joining each insert portion to the continuous marginal portion of the second continuous sheet.

9. The business form assembly of claim 1 in which the connecting parts of the second continuous sheet which join together the insert parts thereof have a row of feed holes therein and the first continuous sheet has a row of feed holes therein in alignment with the feed holes in the second continuous sheet for aligned movement of the first and second continuous sheets.

10. The business form assembly of claim 2 in which each of the sheets has opposed side marginal portions, with a longitudinal row of feed holes in each marginal portion, the series of insert portions being between the marginal portions and spaced therefrom, with a tab joining the marginal portions to each of the insert portions.

11. The business form assembly of claim 2 in which each of the sheets has a longitudinally extending row of feed holes in a margin thereof, the insert portions of the second sheet being positioned laterally with respect to the row of marginal feed holes of the second sheet, with a tab joining each insert portion to the margin thereof within which the row of feed holes is located.

12. A business form assembly comprising:

a first continuous sheet of paper-like material the first continuous sheet having a given width dimension and being divided into sections, each of which has the given width and each of which has a given longitudinal dimension, a second continuous sheet of paper-like material, the second sheet of paper-like material being divided into a series of insert portions, there being one insert portion positioned upon each section of the first continuous sheet, each insert portion having an area less than the area of the section upon which the insert portion is positioned, each insert portion having a width dimension less than said given width dimension and a longitudinal dimension less than said given longitudinal dimension, each insert portion being within the confines of the section of the first continuous sheet upon which the insert portion is positioned, a third continuous sheet of paper-like material, the third continuous sheet beng positioned upon the second continuous sheet, means attaching together the third continuous sheet and the first continuous sheet at the peripheral parts thereof to form envelopes within which the insert portions are positioned, the envelopes being severably attached in series relation, the second continuous sheet having severably connecting parts extending from each insert portion to the insert portions in the envelopes adjacent thereto, the second continuous sheet being free from attachment to either of the other sheets and being free to shift within its respective envelope after the connecting parts are severed with severance of the envelope from the series thereof.

13. The business form assembly of claim 12 in which the second continuous sheet has connection parts joining the insert portions together and extending therebetween and in which the connection parts are spaced from said means attaching together the third continuous sheet and the first continuous sheet.

14. The business form assembly of claim 12 in which the second continuous sheet is free from attachment to the first continuous sheet and the third continuous sheet.

15. In an elongate continuous envelope assembly including a continuous upper sheet and a continuous lower sheet in superposed relation, a series of longitudinally spaced cross lines of weakening within said upper and lower sheets to define a series of detachably connected envelopes, means for attaching said upper and lower sheets together generally around the periphery of each of said envelopes to define a pocket therein, an insert sheet disposed within each of said pockets and being free to shift within said pocket when the corresponding envelope is detached from each adjacent envelope, the improvement comprising means connecting said insert sheet which is disposed within each envelope with the insert sheet in each adjacent envelope while said envelopes remain attached in said continuous envelope assembly to provide for precisely registering each insert sheet within its corresponding envelope pocket during the application of information to the envelopes, said connecting means and said insert sheet being free from attachment to the upper and lower sheets within each envelope.

16. An envelope assembly as defined in claim 15 wherein said means for connecting said insert sheet in each envelope with the insert sheet in each adjacent envelope comprise a marginal tab portion integrally connecting each insert sheet to each adjacent insert sheet, and said means for attaching said upper and lower sheets of each envelope is interrupted to define a gap for receiving said tab portion.

17. An envelope assembly as defined in claim 16 wherein said marginal tab portion of each said insert sheet extends longitudinally relative to said envelope assembly and across a line of weakening.

18. An envelope assembly as defined in claim 16 wherein each of said marginal tab portions extends laterally outwardly relative to said envelope assembly.

19. In an elongate continuous envelope assembly including a continuous upper sheet and a continuous lower sheet in superposed relation, a series of longitudinally spaced cross lines of weakening within said upper and lower sheets to define a series of detachably connected envelopes, means for attaching said upper and lower sheets together generally around the periphery of each of said envelopes to define a pocket therein, a plurality of insert sheet, there being an insert sheet disposed within each of said pockets, said insert sheets having integrally connected marginal portions for holding each insert sheet in precise registration within its corresponding envelope pocket while the envelopes remain attached in said continuous envelope assembly, the improvement wherein said integrally connecting marginal portions are unattached to said continuous upper and lower sheets and provide for releasing each insert sheet for shifting within the corresponding said pocket in response to detaching the corresponding envelope from each adjacent envelope.

20. A method of producing a series of envelope units, each of which has an insert element therein, comprising providing a plurality of continuous sheets of paper material, forming one of the continuous sheets into an insert sheet having a continuous longitudinal strip with a series of spaced-apart insert sections extending laterally therefrom, positioning said insert sheet between two other continuous sheets so that all of the sheets are in superposed relation, attaching together the said two sheets to form a series of envelope pockets within which the series of insert sections is positioned, while maintaining the insert sheet free from attachment to either of the other sheets.

21. The method of claim 20 in which the insert sheet is formed into a pair of continuous opposed marginal strips, with a series of insert sections between the strips and spaced therefrom, and with a tab joining each continuous marginal strip to one of the insert sections.

22. The method of claim 20 in which each of said two sheets is provided with a pair of opposed marginal portions, each of the marginal portions having a longitudinal row of feed holes, said two sheets being arranged so that the rows of marginal feed holes thereof are in vertical alignment, the insert sheet having a row of feed holes, positioning the insert sheet so that the feed holes of the insert sheet are laterally arranged with respect to the feed holes in said two sheets.

23. The method of claim 20 in which said one of the continuous sheets if formed into an insert sheet in which each of said insert sections is joined to the continuous longitudinal strip along the longitudinal dimension of the insert section.

24. The method of claim 20 in which said one of the continuous sheets is formed into an insert in which each of said insert sections is joined to the continuous longitudinal strip by a connecting tab.

25. A business form assembly comprising: a plurality of continuous sheets arranged in superposed relationship, there being a pair of opposed envelope sheets attached together along the length thereof to form a series of pockets, there being a continuous insert sheet loosely positioned between the pair of envelope sheets, the insert sheet having an insert portion within each pocket which is formed by the envelope sheets, the insert sheet having connector portions extending from the insert portions and joining together the insert portions said insert sheet being unattached to said envelope sheets.

26. The business form assembly of claim 25 in which the continuous insert sheet has a continuous marginal portion, the continuous insert sheet having parts joining each insert portion to the continuous marginal portion.

27. The business form assembly of claim 25 in which the continuous insert sheet has parts extending in a longitudinal direction from the pockets and joining together the insert portions.

28. The business form assembly of claim 25 in which each of the envelope sheets has a pair of continuous opposed marginal portions, the insert sheet being positioned between the marginal portions and having connecting parts extending in a longitudinal direction between the insert portions.

29. A business form assembly comprising: a pair of superposed continuous envelope sheets, each of which has opposed continuous longitudinally extending marginal portions, a pair of longitudinally extending lines of adhesive, there being a longitudinally extending line of adhesive joining together the envelope sheets adjacent each of the marginal portions, a series of spaced-apart transversely extending lines of adhesive positioned between the longitudinally extending lines of adhesive so the pair of continuous envelope sheets has a series of pockets, each of the transverse lines of adhesive having a gap therein which forms an opening between adjacent pockets, a continuous insert sheet, the continuous insert sheet having a series of insert portions, there being an insert portion within each of the pockets, the insert sheet having a series of connector parts which extend through the openings between adjacent pockets and join together the insert portions said insert sheet being unattached to said envelope sheets.

30. The business form assembly of claim 29 in which one of the envelope sheets has a longitudinal row of feed holes and the insert sheet has a longitudinal row of feed holes, aligned with the row of feed holes of said envelope sheet.

31. The business form assembly of claim 30 in which the row of feed holes in the insert sheet is in a marginal part thereof and in which the row of feed holes in the envelope sheet is adjacent one of the marginal portions thereof, there being a longitudinally extending perforation line in the envelope sheets adjacent said one marginal portion of said one envelope sheet and separating the marginal portion thereof from the row of feed holes therein.

32. A business form assembly comprising:

a first continuous sheet of paper material of indefinite length and uniform width, having transverse lines of weakening at uniform intervals along its length, said lines of weakening dividing said sheet of indefinite length into a series of sections of uniform dimension, a second continuous sheet of paper material of essentially the same description as said first continuous sheet and positioned in superposed relationship above said first continuous sheet so that longitudinally extending marginal side portions thereof are in register, a continuous insert sheet of paper material of lesser width than said first and second continuous sheets, said insert sheet having at least one continuous longitudinally extending marginal portion and a series of integral insert portions which extend laterally from the continuous longitudinally extending marginal portions, each insert portion being separated from each adjacent insert portion by a transversely extending elongate slot, said slots being positioned along said insert sheet at regular intervals substantially equal to the intervals between the lines of weakening in said first and second continuous sheets, said insert sheet being located between said first and second continuous sheets in a position in which both of the side edges of the insert sheet are positioned inwardly of the marginal portions of said first and second continuous sheets and said elongate slots of said insert sheet are substantially aligned with said transverse lines of weakening in said first and second continuous sheets, means attaching said first continous sheet and said second continuous sheet together adjacent the registered longitudinal margins and transverse lines of weakening thereof, so that a series of closed envelopes is formed, each envelope in the series thereof containing therewithin an insert portion held in registration within its respective envelope by the continuous marginal portion of said insert sheet which extends continuously through the series of envelopes.

33. A business form assembly comprising:

a first continuous sheet of paper material of indefinite length and uniform width, having transverse lines of weakening at uniform intervals along its length, said lines of weakening dividing said sheet of indefinite length into a series of sections of uniform dimension, a second continuous sheet of paer material of essentially the same description as said first continuous sheet and positioned in superposed relationship above said first continuous sheet so that longitudinally extending marginal side portions thereof are in register, a continuous insert sheet of paper material of lesser width than said first and second continuous sheets, said insert sheet having at least one continuous longitudinally extending marginal portion and a series of integral insert portions which extend laterally from each of the continuous longitudinally extending marginal portions, each insert portion being separated from each adajcent insert portion by a transversely extending elongate slot, said slots being positioned along said insert sheet at regular intervals substantially equal to the intervals between the lines of weakening in said first and second continuous sheets, said insert sheet being located between said first and second continuous sheets in a position in which both of the side edges of the insert sheet are positioned inwardly of the marginal portions of said first and second continuous sheets and said elongate slots of said insert sheet are substantially aligned with said transverse lines of weakening in said first and second continuous sheets, adhesive means within each of the elongate slots attaching together the first continuous sheet and the second continuous sheet to form a series of pockets.

34. The business form assembly of claim 33 which includes means adjacent the longitudinally extending marginal side portions attaching the first continuous sheet to the second continuous sheet.

* * * * *

UNITED STATES PATENT OFFICE

CERTIFICATE OF CORRECTION

PATENT NO. 3,941,308

DATED March 2, 1976

INVENTOR(S) John S. DiGirolomo, Hugh Skees, Mario Giuffre, F. Leo Vath

It is certified that error appears in the above-identified patent and that said Letters Patent are hereby corrected as shown below:

Column 6, line 15, change "a" to ---A---.

Claim 1, Column 7, line 62, change "wich" to ---which---.

Claim 19, Column 10, line 52, change "sheet;" to ---sheets---.

Claim 24, Column 11, line 29, after "insert", insert ---sheet---.

Signed and Sealed this eleventh Day of May 1976

[SEAL]

Attest:

RUTH C. MASON
Attesting Officer

C. MARSHALL DANN
Commissioner of Patents and Trademarks